US005570865A

United States Patent [19]

Godfrey

[11] Patent Number: 5,570,865

[45] Date of Patent: Nov. 5, 1996

[54] ARTICLE RESTRAINT AND FALL PREVENTION DEVICE

[76] Inventor: Kenneth E. Godfrey, 7337 Pasito Ave., Rancho Cucamonga, Calif. 91730

[21] Appl. No.: 307,343

[22] Filed: Sep. 16, 1994

[51] Int. Cl.[6] ..... A47B 96/06

[52] U.S. Cl. ..... 248/226.11; 248/222.11; 248/300; 403/294

[58] Field of Search ..... 248/222.1, 225.31, 248/300, 558, 682; 403/294, 384, 388

[56] References Cited

U.S. PATENT DOCUMENTS

| | | | |
|---|---|---|---|
| 327,939 | 10/1885 | Garrison | 248/222.1 |
| 1,908,147 | 5/1933 | Hoegger | 248/300 |
| 2,509,669 | 5/1950 | Borst | 403/294 |
| 2,530,892 | 11/1950 | Mayo | 248/300 |
| 2,789,782 | 5/1957 | Huth | 248/300 |
| 2,863,683 | 12/1958 | Peterson et al. | 403/388 |
| 2,891,757 | 6/1959 | Lang | 248/300 |
| 2,916,234 | 12/1959 | Bogar | 248/222.1 |
| 3,135,489 | 6/1964 | Gledhill | 248/223 |
| 3,282,006 | 11/1966 | Halsey et al. | 403/384 |
| 3,291,428 | 12/1966 | Sisulak | 248/300 |
| 3,989,215 | 11/1976 | Weston | 248/224 |
| 4,075,924 | 2/1978 | McSherry et al. | 85/3 R |
| 4,612,740 | 9/1986 | Yamamoto | 52/36 |
| 4,846,760 | 7/1989 | Betterton et al. | 403/294 |
| 4,846,762 | 7/1989 | Betterton et al. | 403/294 |
| 4,863,132 | 9/1989 | Fitzgerald et al. | 248/274 |
| 4,874,266 | 10/1989 | Thompson et al. | 403/407.1 |
| 5,090,652 | 2/1992 | Cattaneo | 248/222.1 |
| 5,240,212 | 8/1993 | Brodie | 248/225.31 |

FOREIGN PATENT DOCUMENTS

| | | | |
|---|---|---|---|
| 4-67507 | 3/1992 | Japan | F21V 21/04 |
| 926030 | 5/1963 | United Kingdom | 403/384 |

OTHER PUBLICATIONS

International Search Report: PCT/US95/11740.

*Primary Examiner*—Leslie A. Braun
*Assistant Examiner*—Richard M. Smith
*Attorney, Agent, or Firm*—Fulwider Patton Lee & Utecht

[57] ABSTRACT

A restraint device is disclosed comprising a wall bracket, an article bracket, a bridging member and a fastening component. When installed at or near the top of an article of furniture or appliance, the brackets provide an aperture or recess between the brackets and the vertical surface to which they have been fastened in which a pair of legs of the bridging member can be inserted. The bridging member forms a mechanical lock between the brackets which, when necessary, can very simply be disengaged. A method in accordance with the present invention for securing articles to a vertical surface, such as a wall, is provided which includes a few simple unskilled steps. Accordingly, one of the advantages of the restraint device of the present invention is its simplicity and ease of installation.

13 Claims, 6 Drawing Sheets

ARTICLE RESTRAINT AND FALL PREVENTION DEVICE

BACKGROUND OF THE INVENTION

1. Field of the Invention

This invention relates generally to supports and brackets for securing freestanding articles and more particularly for securing furniture or appliances which have at least one side facing in close proximity a wall or similar structure to which the article may be mechanically attached.

2. Description of Related Art

A need exists for a fall prevention and restraint device for articles such as furniture and appliances to minimize the possibility of accidental or forced physical displacement or movement of the article. Such unwanted movement is frequently the result of human contact, such as children climbing on an article, such as a dresser or cabinet. Many children die each year as a result of climbing on furniture and thereby placing themselves in the path of the falling article. In certain areas of the world, earthquakes frequently move or topple furniture and appliances, causing great economic damage and bodily injury.

Heretofore, products designed to limit movement of such articles have been bulky and difficult to install without professional help and equipment. Similarly, many such devices required extensive dismantling of the device before the article could be moved for cleaning or other access. Many prior devices required some form of tool to disengage their operation to gain access to the wall side of the article of restraint. Moreover, such devices were typically aesthetically undesirable when installed.

For example, the device in U.S. Pat. No. 4,612,740 (Sep. 23,1986) to Yamamoto requires a high level of precision during its installation to ensure proper results. The Yamamoto device also appears to require extensive, precise and costly means of manufacture. The embodiments which require installation at the floor would likely be inadequate to restrain tall heavy articles due to the leverage that would be applied to the device. Similarly, certain embodiments would not prevent the article from moving sideways and becoming disengaged. Moreover, an opening must be available or cut in the article large enough to pass a human hand through. Thus, the device is likely unsuitable for many office and home uses.

The device disclosed in U.S. Pat. No. 4,863,132 (Sep. 5, 1989) to Fitzgerald is generally bulky as well as being unsightly when installed. The device also requires manufacturing a large number of components, approximately fourteen, not including mechanical fasteners. This proper use of the Fitzgerald device may also dictate the additional manufacturing procedure of applying a cohesive foam bedding to the device. The exposed bridging component is not only unsightly, it may also be a source of bodily injury.

The device of U.S. Pat. No. 3,989,215 (Nov. 2, 1976) to Weston appears to require a high level of precision during its installation to align the components. The device also appears to require die cutting, an extensive, precise and costly means of manufacture which produces scrap waste material. Since the device is merely a two piece construction, the article must be lifted to engage the device, making the installation of large articles unnecessarily difficult.

Therefore, there is needed a device which can be easily and quickly disconnected by human hand in a simple lifting or sliding motion. Likewise, there is needed a device which can be fabricated in a low cost process. The device should be easy to understand and to install properly without extraordinary skill or the extensive use of tools.

SUMMARY OF THE INVENTION

Briefly, and in general terms, the present invention provides a restraint device including support brackets and a bridging member for securing furniture and appliances to a wall or similar structure. The restraint device of the present invention overcomes many of the disadvantages of the prior art. Along with the life saving potential of the invention, it affords an additional degree of economic security against physical displacement of an article which may result from earthquakes, high winds and the like. The restraint device is easy to use, simple to install and low cost to manufacture. It is designed for both home and office use, and is equally suitable for industrial applications.

A restraint device is disclosed comprising a wall bracket, an article bracket, a bridging member and a fastening component. Both the wall bracket and the article bracket have a cross-sectional configuration similar to a collapsed top hat. The bridging member is formed in a U-shaped or hairpin-like cross-sectional configuration or alternate configuration which secures the article bracket to the wall bracket. When installed at or near the top of an article of furniture or appliance on its wall side, the brackets provide an aperture or recess between the brackets and the surface to which they have been fastened. Such surfaces may be that of the wall and article or interposing plates may be used to secure the brackets. With the article of restraint properly positioned and both brackets installed, the legs of the bridging member can be inserted into each bracket recess. The bridging member forms a mechanical lock between the brackets, thereby achieving a fall prevention and restraint device for the article of furniture or appliance, which, when necessary, can very simply be disengaged.

A method in accordance with the present invention for securing articles, such as furniture or appliances, to a vertical surface, such as a wall, is provided which includes a few simple unskilled steps. These installation steps may be performed my most laymen with ordinary tools found in the home or workplace. First, a bracket having an indentation is secured to a vertical surface of an article, preferably near the top of the article. Next, a second bracket having an indentation is secured to a vertical surface, for example, a wall, at about the same height from a floor as the article bracket. The vertical surface should be sturdy and be suit- able to hold the article in place during human interaction, earthquakes and the like. The brackets may be secured to the article and wall by screws, nuts and bolts or similar means. Finally, the article bracket is secured to the second bracket with a bridging component configured to be slidably disposed within the indentation of the article bracket and the indentation of the second bracket. The article may be moved away from the wall by removing the bridging component, which may have an upwardly protruding appendage for grasping by hand.

Accordingly, one of the advantages of the present invention is its simplicity and ease of installation. Yet, the restraint device in accordance with the invention is structurally robust when secured to the article of restraint. The restraint device achieves this structural integrity without relying on the often cumbersome, dangerous and expensive components found in the prior art. An additional advantage is that the article of furniture or appliance need not be lifted during the installation of the restraint device. Similarly, installation of the restraint device may not re-quire displacement of the article upon which it is being installed. Moreover, typical installation procedures do not require the use of any measuring tools or require precise accuracy during installation to insure the structural integrity or intended performance of the restraint device.

When installed, the restraint device of the present invention is minimally noticeable and not an eyesore, as are some prior solutions to the furniture restraint problem. Since the device is installed at or near the top of the article being restrained and is installed on the wall side of the article, the restraint device is almost entirely out of the line of sight. Also, if the installed restraint device should be entirely removed, the device will leave behind no unsightly markings anywhere on the visible portions of the article upon which it had been installed. Likewise, only minimal and easily repairable securement sites remain in the wall after removal of the restraint device.

Should the need arise to gain access to the wall or concealed side of the article of restraint after installation, the restraint device can be quickly and easily disunited by removing the interlocking bridging member. When the restraint device is disconnected and the article of restraint moved, the consumer will not be subjected to any sharp or protruding members which could be a source of bodily injury. This simplified disconnect procedure facilitates cleaning and moving of the furniture and walls, without the need of specialized tools or skills.

The cost of manufacturing the restraint device of the present invention is minimized by fabrication in a simple one step shearing-punching procedure. The entire manufacturing process can be performed in one quick, cost effective step. The device may be fabricated effectively from a number of materials including, but not limited to, ferrous or nonferrous metals, composite materials, injection molded plastics, extruded aluminum or the like. In addition, the restraint device requires almost no consumer assembly, making the restraint device very attractive from a retailer's perspective. Consequently, the restraint device may be packaged for retail sales in a self-contained virtually flat film-covered card. This packaging allows the consumer to visually inspect the device and installation instructions, thereby enhancing the marketability of the invention.

Other features and advantages of the present invention will become apparent from the following detailed description, taken in conjunction with the accompanying drawings, which illustrate, by way of example, the principles of the invention.

DESCRIPTION OF THE PREFERRED EMBODIMENTS

Figure 1:
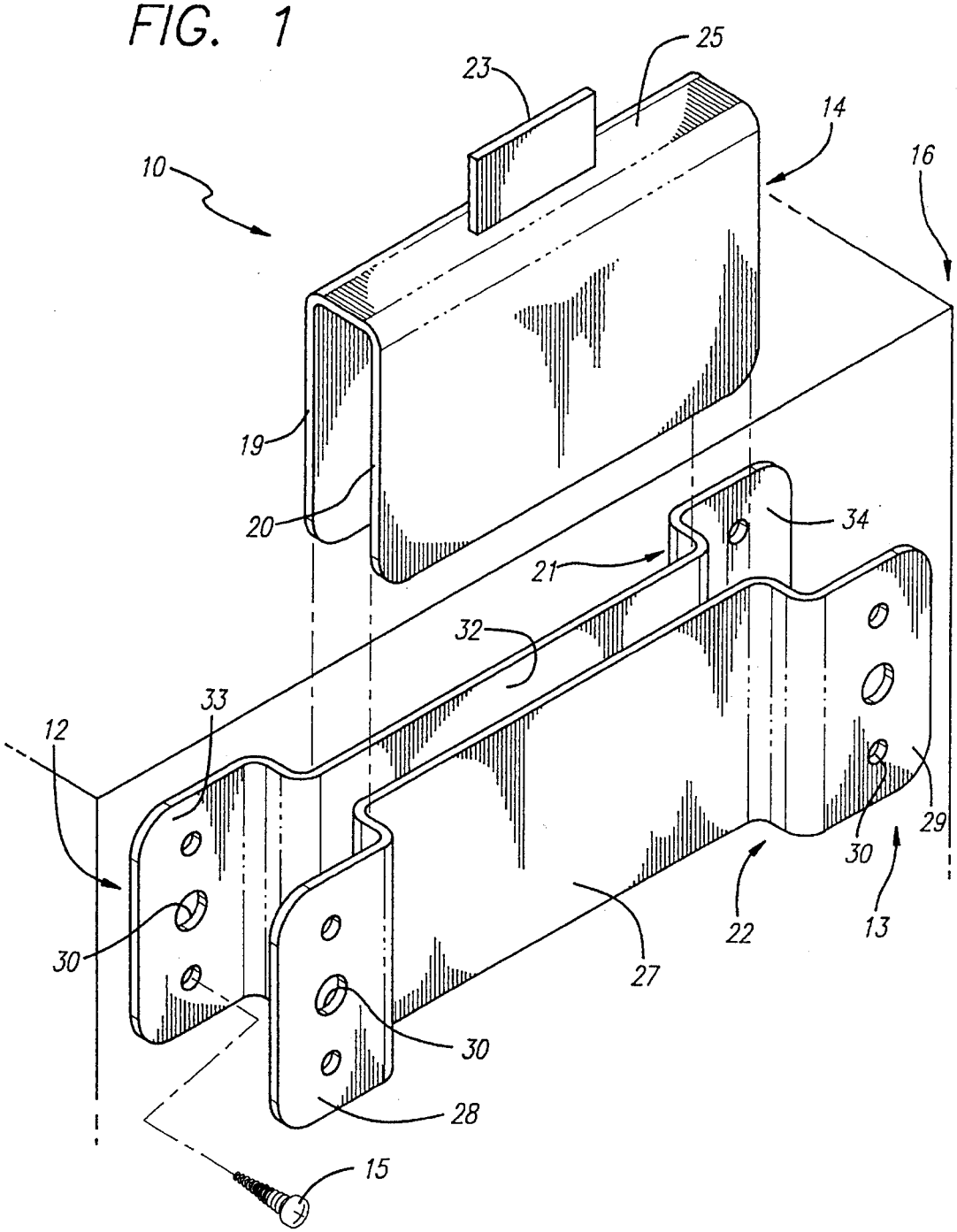
FIG. 1 is an exploded perspective view of a restraint device in accordance with the present invention.

As shown in the exemplary drawings, the present invention comprises support brackets and bridging members for securing an article of restraint, such as furniture and appliances, to vertical structure, such as a wall. A need exists for a fall prevention and restraint device for articles such as furniture and appliances to minimize the possibility of accidental or forced physical displacement or movement of the article. Heretofore, products designed to limit movement of such articles have been bulky and difficult to install without professional help and equipment and were typically aesthetically undesirable hen installed. A restraint device in accordance with the present invention is easy to use, simple to install and low cost to manufacture. Moreover, the embodiments of invention are suitable for home, office and industrial applications.

As best observed in FIGS. 1–5 of the drawings, wherein like reference numerals denote like or corresponding parts throughout the various figures, a restraint device 10 is disclosed comprising an article bracket 12, a wall bracket 13, a bridging member 14 and a fastening component 15. In the preferred embodiments, both the wall bracket and the article bracket have a cross-sectional configuration similar to a collapsed top hat. With an article of restraint 16 properly positioned proximate a vertical structure (not shown) and both brackets installed, a pair of legs 19, 20 of the bridging member can be inserted into recesses 21, 22 formed by each bracket. The bridging member forms a mechanical lock between the brackets, which can be purposefully disengaged using an upwardly extending appendage 23 from the bridging member. Furthermore, the method for securing articles with such a restraint device comprises a few simple unskilled steps. Such installation steps may be performed by most laymen with ordinary tools found in the home or workplace.

Referring now more particularly to FIG. 1, the primary embodiment of the restraint device 10 of the present invention is used to secure an article of restraint 16, such as a piece of furniture or an appliance to a vertical surface (not shown), such as a wall of a building. The restraint device comprises an article bracket 12 and a wall bracket 13 and a bridging member 14. The bridging member has a generally U-shaped cross-sectional configuration, similar to that of a large hairpin. The bridging member includes a bridging component 25 joined to two rectangular parallel plates which form a first leg 19 and second 20. The bridging component may be flat and formed at right angles to the plates, or may be arcuate, providing for a more rounded shape. An optional appendage 23 may be mounted on the bridging component of the bridging member for grasping the bridging member with a human hand. The appendage assists in the installation and removal of the bridging member.

In the preferred embodiment, the article bracket 12 and the wall bracket 13 are formed as two substantially identical components. Both brackets are configured with a cross-sectional configuration similar to that of a collapsed top hat. For example, the wall bracket is formed from an elongate rectangular plate 27 of a sturdy material, such as metal or strong plastic. The plate is bent or similarly formed with a first rectangular mounting flange 28 and a second rectangular mounting flange 29 located at opposite ends of the plate. The bends which form the mounting flanges on the wall bracket establish a recess 22 on the inside face of the elongate plate, creating a space between the mounted bracket and the wall.

One or more mounting holes 30 are drilled or formed in each mounting flange 28, 29 for fastening the wall bracket 3 to a vertical surface, such as a wall. The mounting holes may include two small holes as well as one large hole to allow for the use of a wide range of mechanical fasteners 15, such as a number fourteen, one and one-half inch self-tapping screw or suitable "toggle" type hollow wall anchor and matching machine screw. An especially suitable fastening component is a toggler bolt sold under the trademark "Toggler" by the Mechanical Plastics Corp. of Elmsford, N.Y.

The article bracket 12 is installed at or near the top of the article of restraint 16 between the article of restraint and a nearby wall or similar vertical structure. The article bracket is axially rotated 180 degrees in relation to the wall bracket 13. As with the wall bracket, the article bracket is formed of an elongate rectangular plate 32 having bends at each end which form a pair of rectangular mounting flanges 33, 34 and establish a recess 21 between the article and the bracket. When properly aligned, the article bracket plate and the wall bracket plate 27 rest in close proximity to each other. Thus, the article bracket recess and the wall bracket recess 22 are separated by the bracket plates and may be traversed by the bridging member 14.

A mechanical lock is created by placing each of the components of the restraint device 10 in close proximity to one another. First, the article bracket 12 is secured to the article of restraint at a desired location near the top of the article with the fastening components 15. Next, the height of the article bracket is marked on the wall or similar vertical surface upon which the wall bracket 13 is to be mounted. The wall bracket then is aligned with the mark and secured to the vertical surface with the fastening components. Then, the article is moved in close proximity to the wall. With the wall bracket plate 27 resting substantially flush against the article bracket plate 32, the first leg 19 of the bridging member is slid into the article bracket recess 21. At the same time the second leg 20 of the bridging member is slid into the wall bracket recess 22. The bridging member is configured to fit snugly in each recess, with the bridging component 25 resting on top of the two bracket plates. The legs of the bridging member prevent the article bracket plate and the wall bracket plate from moving substantially in a longitudinal or axial direction. Thus, the article is secured to the wall until the bridging member is removed.

The restraint device 10 may be sized with dimensions to accommodate various articles of restraint 16 designed for the size and weight of typical articles of home or office furniture. For merely purposes of example and not intended to limit the scope of the invention, the elongate wall plate 27 and article plate 32 are formed from sheet metal eight inches long by one and three quarters inches wide and one sixteenth of an inch thick. The bridging member 14 is about four and three quarters inches long, having a bridging component 25 about one half of an inch wide, where the thickness of the material is about one sixteenth of an inch. The legs of the bridging member 19, 20 extend about two inches from the bridging component, or at least a distance sufficient for a sturdy mechanical lock when the components are engaged.

Figure 2:
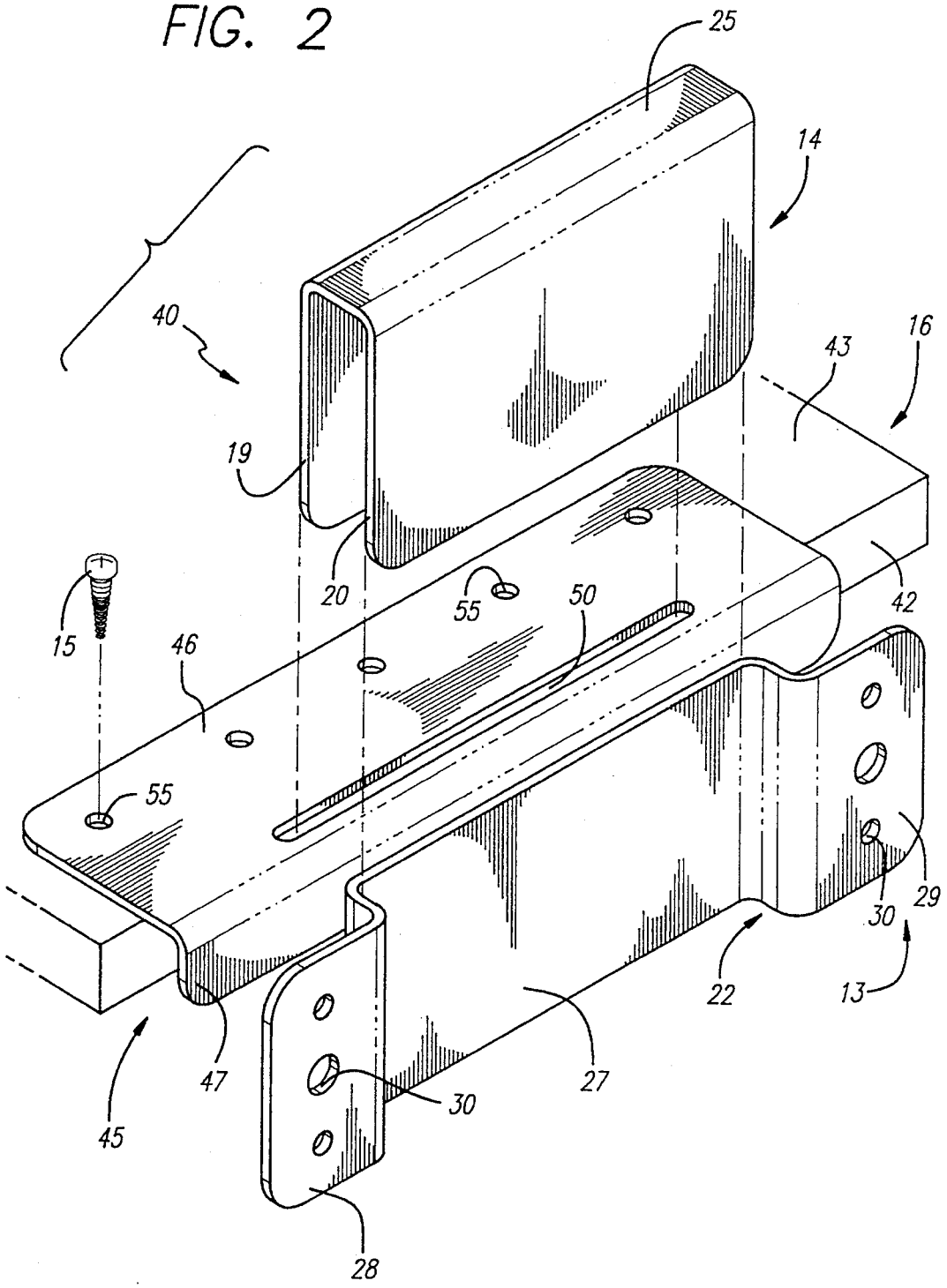
FIG. 2 is an exploded perspective view of an alternate embodiment of the restraint device, wherein the bridging member fits within a slot of the article bracket.

As shown in FIG. 2, an alternative embodiment of a restraint device 40 is disclosed for use with an article of restraint 16 having a relatively short ledge or wall 42, inadequate for mounting a bracket as heretofore described. This alternative embodiment of the restraint device uses the same configuration of a wall bracket 13 and bridging member 14 as described above. However, an article bracket 45 is provided configured in an "L" shape. Alternatively, flat plate bracket could suffice as the article bracket.

The article bracket 45 is formed from a flat rectangular plate 46 having a rectangular stop flange 47 at a right angle along one edge. The stop flange is formed large enough to press firmly against the wall bracket plate 27 when the article of restraint 16 is positioned close to the wall or similar vertical structure (not shown). The article bracket plate further includes a bridging member aperture 50, which is formed as an elongate slot-like opening proximate the edge forming the stop flange. Also included in the article bracket plate is a plurality of mounting holes 55 for placement of screws 15 or similar fasteners for securing the article bracket to the top surface 43 of the article of restraint.

The alternative embodiment of the restraint device 40 shown in FIG. 2 allows for the article bracket 45 to be mechanically attached to the top surface 43 or the underside of the top of the article of restraint 42. The "L"-shaped cross-sectional configuration of the article bracket eliminates the need of a solid surface on the wall side of said article of restraint, as is required if a standard article bracket 12 is used. To provide a recess for securing the first leg 19 of the bridging member 14, the article bracket is configured with a long narrow bridging member aperture or slot 50. With the wall bracket plate 27 resting substantially flush against the article stop flange 47, the first leg 19 of the bridging member is slid into the bridging member aperture and the second leg 20 is slid into the wall bracket recess 22, thereby forming a mechanical lock between the article bracket and the wall bracket.

Figure 3:
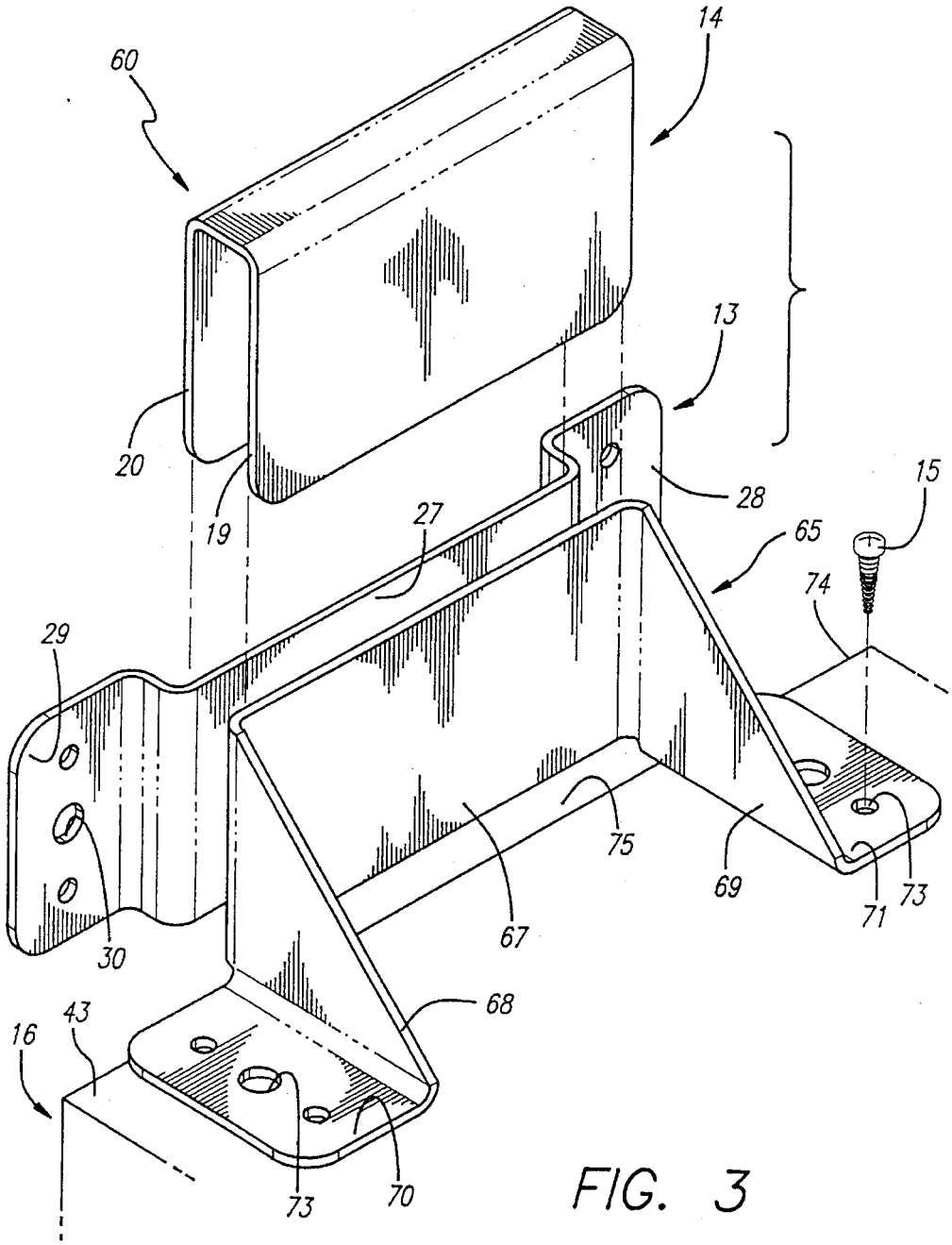
FIG. 3 is an exploded perspective view of an alternate embodiment of the restraint device, wherein the article bracket mounts above the article of restraint.

As shown in FIG. 3, an alternative embodiment of a restraint device 60 is disclosed for use with an article of restraint 16 in which it is desirable to mount the restraint device on a top surface 43 of the article. This alternative embodiment of the restraint device may be preferable to other embodiments where the article has inadequate support for mounting a bracket on an inside vertical surface of the article. The restraint device, however, uses the same configuration of a wall bracket 13 and a bridging member 14 as described heretofore. The article bracket 65, however, is configured to be mounted on the top surface of the article.

The article bracket 65 is configured with a flat surface or elongate rectangular center plate 67 which stands perpendicular to the top surface 43 of the article 16. The center plate is bent at a ninety degree (right) angle at each of its two ends to form two gussets 68, 69 which are perpendicular to the center plate and extend away from wall when the restraint device 60 is mounted on the article and wall. These gussets are preferably cut at a forty-five degree angle from the top of the center plate to the top surface of the article. The gussets, however, may be formed at various angles, depending upon the manufacturing technique of the article bracket.

The gussets 68, 69 are bent into or affixed to two rectangular mounting flanges 70, 71. The mounting flanges are preferably at right angles to the gussets and lie flush with the top surface 43 of the article 16. The flanges preferably extend away from the gussets and toward each outside edge of the article; however, the flanges may be formed on the inside of each gusset. The flanges act as supports for the article bracket and are provided with mounting holes 73 used to support fasteners such as screws 15. The entire article bracket 65 may be formed from a single piece of metal or the like, but may also be made from separate pieces and joined together by welding or a similar bonding process.

To secure the article of restraint 16, the article bracket first is secured to the top surface 43 of the article along an inside edge 74 of the article which will face the wall or other vertical surface. The center plate 67 is extended slightly, for example, a distance just slightly greater than the thickness of the legs 19, 20 of the bridging member 14, over the inside edge of the article to form an article bracket recess 75 for receiving the first leg of the bridging member. Next, the wall bracket 13 is mounted on the wall at the same height as the center plate of the article bracket. The bridging member is then slid into place with the first leg disposed on the outside of the center plate and into the article bracket recess. At the same time, the second leg 20 of the bridging member is disposed in the recess formed between the wall bracket and the wall, forming a mechanical lock as heretofore described. To aid in the stability of the restraint device, the legs of the bridging member may be longer than in the embodiments previously described. Although the design of this embodiment of the restraint device allows it to be in the line of sight when mounted on short articles, it has the advantage that the restraint device may be mounted on the article and wall without moving the article significantly, if at all, from the wall.

Figure 3A:
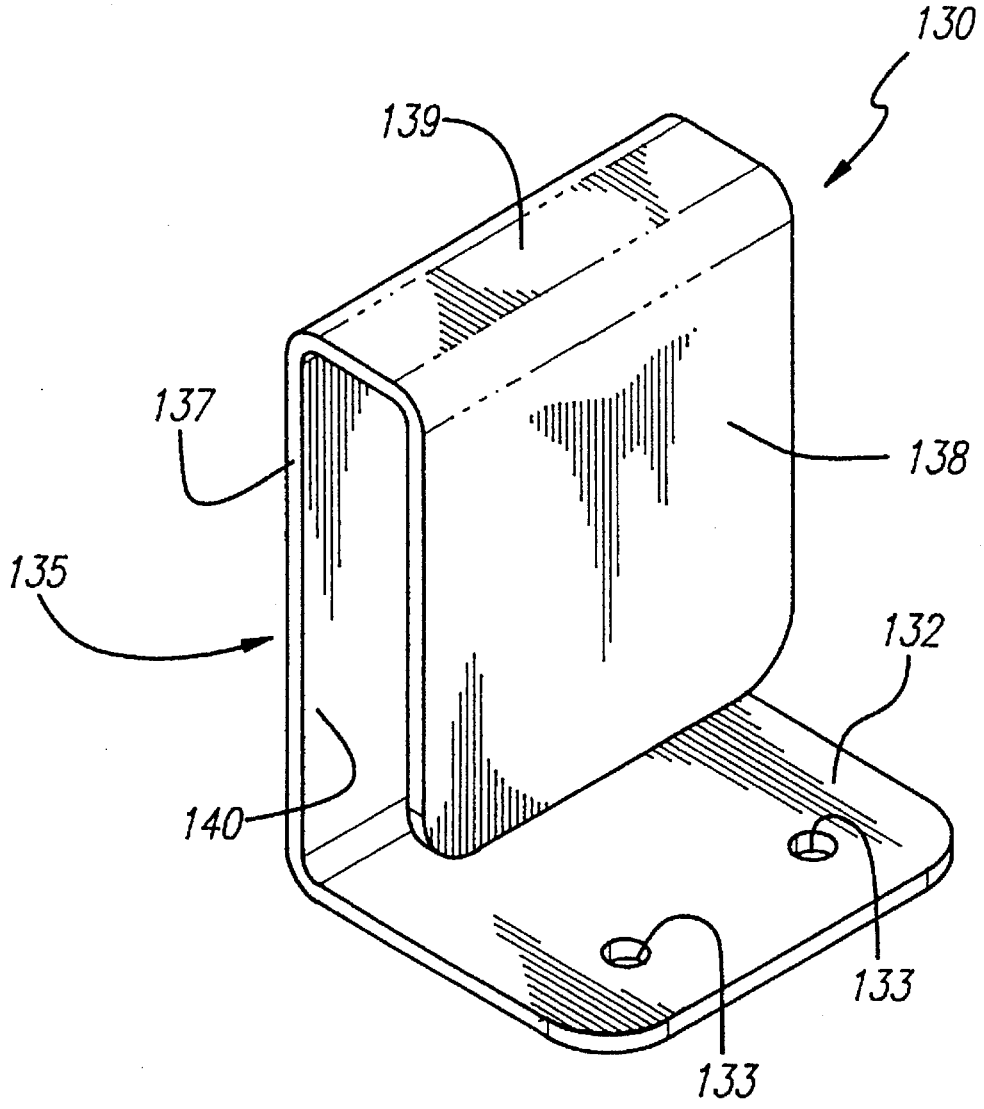
FIG. 3A is a perspective view of a mounting pedestal for use wit the article bracket or wall bracket of FIG. 1.

As shown in FIG. 3A, a mounting pedestal 130 may be separately provided to give support for an article bracket 12. The mounting pedestal is configured with a rectangular mounting flange 132 which forms the base of the pedestal. The mounting flange includes mounting holes 133 for securing the mounting pedestal to the top surface 43 of the article of restraint 16, as shown in FIGS. 2 and 3. The mounting pedestal further includes a gripping member 135 preferably bent from a single piece of metal, or welded to the mounting flange.

The gripping member 135 is preferably U-shaped and is comprised of a rectangular support member 137 formed at a right angle to the mounting pedestal flange 132 and further comprises a rectangular biasing member 138 formed parallel to the support member. The support member and biasing member are joined by a bridging potion 139, or may be formed as a single U-shaped assembly. The support member and biasing member form a slot 140 in the gripping member such that the biasing member will firmly grip the mounting flanges 33 or 34 of an article bracket 12 when the article bracket mounting flanges are slidably disposed in the gripping member. Alternatively, the gripping member may be extruded to form the mounting pedestal slot or the biasing member may be folded over the mounting pedestal flange and provided with mounting holes for added strength.

The mounting pedestal 130 may be secured to the article 16 with the gripping member 135 pointed downward, parallel and adjacent to the inside ledge 42 of the article. Secured in such a fashion, the mounting pedestal serves the same basic purpose as the flat plate and stop flange of the embodiment of the restraint device 40 shown in FIG. 2. A bridging member 14 may be then used to secure a mechanical lock between an article bracket 12 disposed in each slot 140 of a pair of mounting pedestals secured to the top surface 43 of the article and a wall bracket 13 secured to a vertical surface. If, however, the mounting pedestal is secured to the article with the gripping member pointed upward or away from the top surface of the article, then a pair of mounting pedestals serve the same relative purpose as that of the gussets 68, 69 and mounting flanges 70, 71 of the embodiment of the restraint device 60 shown in FIG. 3.

Figure 4:
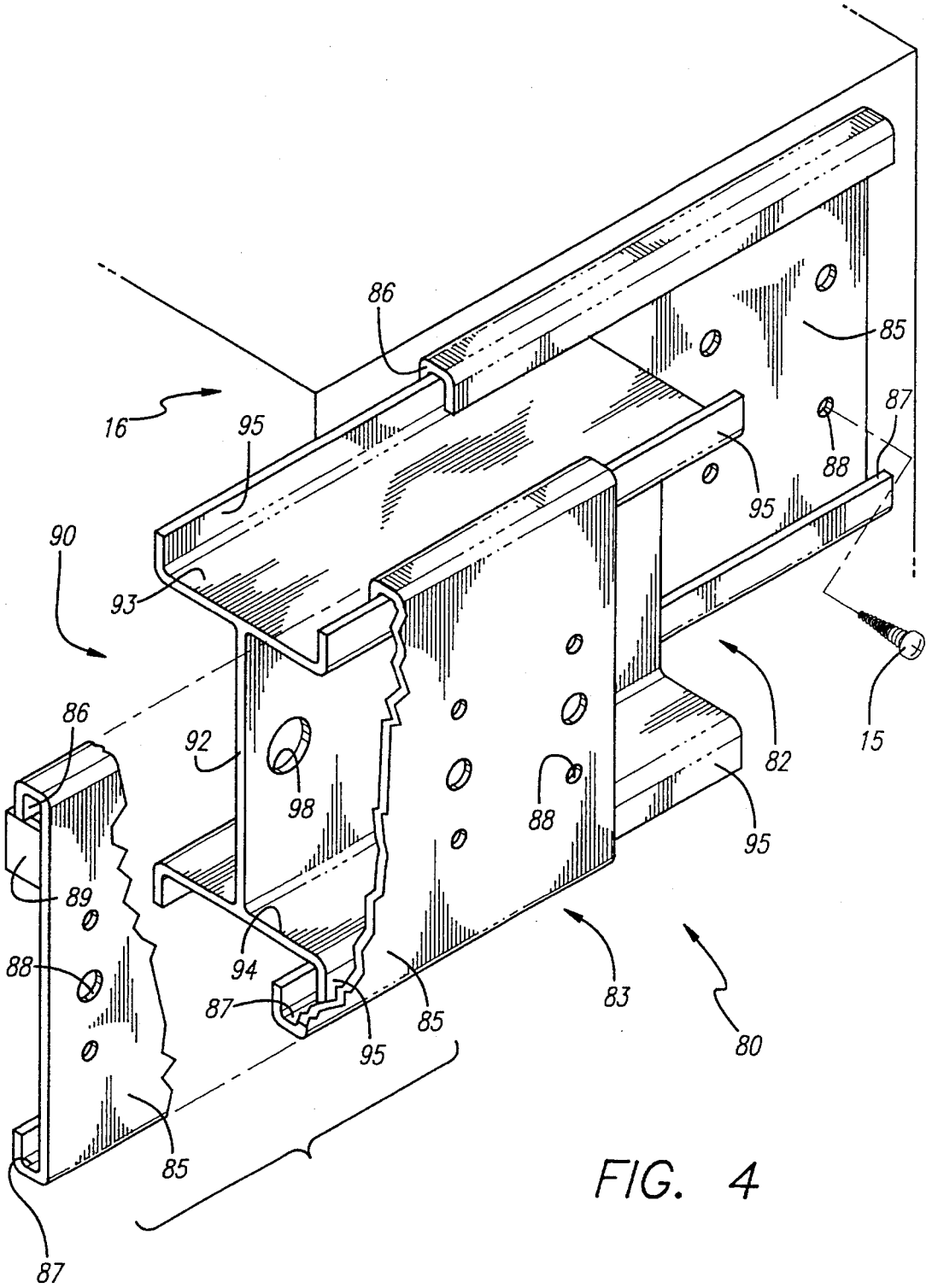
FIG. 4 is an exploded perspective view of an alternative embodiment of the restraint device, wherein the bridging member is configured in the form of an I-beam.

Shown in FIG. 4 is an alternate embodiment of the restraint device 80 which can be larger and heavier than the embodiments heretofore described. This embodiment provides for more demanding applications where the article of restraint 16 is very tall or bulky, and is especially suitable for industrial articles. The restraint device has the option of being installed vertically or horizontally, depending on the need.

The restraint device 80 comprises an article bracket 82 and a wall bracket 83, shown in partial cross section. The article bracket and wall bracket may be configured identical in shape. Each bracket is formed from a rectangular elongate plate 85 having a U-shaped bend formed on two of its opposite edges. Thus, the bracket would have a cross-sectional configuration similar to that of a letter "C". The U-shaped bends, preferably formed at two right angles, form two sets of grooves 86, 87, one at each of the opposite edges of the bracket, for receiving and securing a bridging member 90. A stop tab 89, which can be a small outwardly bent tab on one end of the elongate plate, is formed in the wall bracket to retain the bridging member during vertical installation of the restraint device. Each bracket is further provided with a plurality of mounting holes 88 spaced relatively farther apart for added load distribution.

The bridging member 90 is formed in a cross-sectional configuration similar to that of two collapsed top hats with one stacked upside down atop the other, somewhat resembling an I-beam. The bridging member comprises a rectangular center plate 92 which is disposed parallel to the elongate plates 85 of the article bracket 82 and the wall bracket 83 when the components of the restraint device 80 are engaged. Two rectangular spacing plates 93, 94 are configured perpendicular to the center plate at two of its opposite edges and are centered on and fixed to the center plate. Two edges of each spacing plate which are furthermost away from the center plate are bent at right angles away from the opposite spacing plate and parallel to the center plate to form lips or tongues 95 which fit snugly into each of the grooves 86, 87 of the article bracket and the wall bracket. Further included in the bridging member is an round aperture 98 for grasping the bridging member.

FIG. 4 shows the restraint device 80 installed in a horizontal position to the wall side of the article of restraint 16. During vertical installation, the stop tab 89 is disposed on the wall bracket 83 and faces the floor, thereby preventing the bridging member 90 from sliding out of the grooves 86, 87 of the article bracket 82 and the wall bracket. The aperture 98 is recommended for the ease of installation or removal of the bridging member. The I-beam shape of the bridging member allows the bridging member to be installed without interference with the mechanical fasteners 15 used to attach both the article bracket and the wall bracket.

Figure 5:
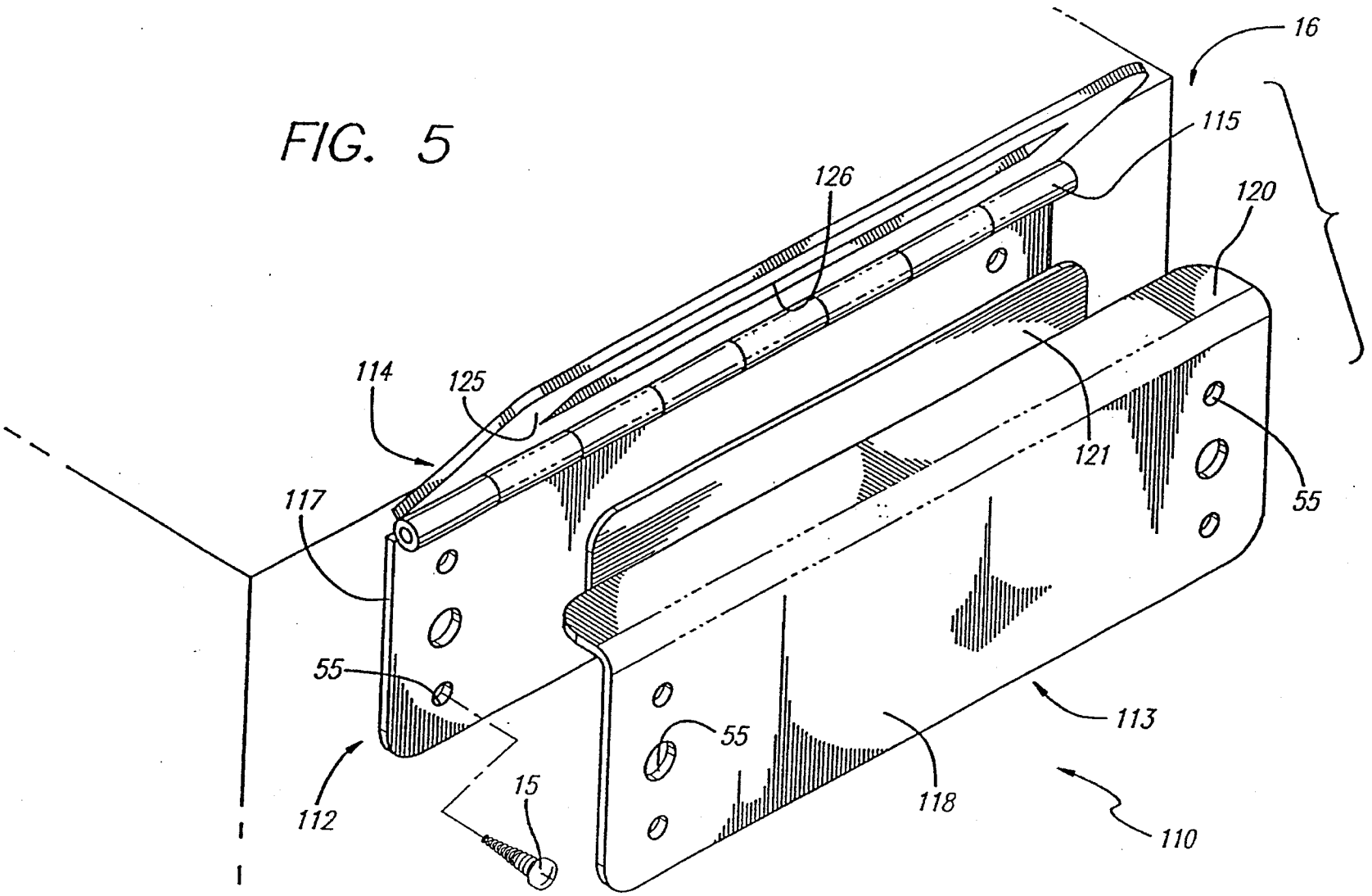
FIG. 5 is an exploded perspective view of a restraint device, wherein the bridging member is affixed to the article bracket by means of a hinge.

As shown in FIG. 5, an alternate embodiment of a restraint device 110 may be constructed having a article bracket 112, a wall bracket 113 and a bridging member 114, wherein the bridging member is joined to the article bracket by a hinge 115. The article bracket is formed from a rectangular elongate mounting plate 117 having a plurality of mounting holes 55 for receiving the fastening components 15. The wall bracket also comprises a rectangular elongate mounting plate 118, and further includes a resting flange 120 formed at a right angle to the wall mounting plate. A retaining appendage 121 having a length smaller than that of the resting flange and mounting plate is formed or bent at a right angle at an edge furthest away from and extending in the direction opposite to the wall mounting plate. Thus, the wall bracket has a cross-sectional configuration similar to that of the capital letter "Z". The wall mounting plate further includes a plurality of mounting holes for receiving fastening components.

The bridging member 114 is formed from a rectangular elongate plate 125 having a slot like opening 126 which will accept the upward turned retaining appendage 121 on the resting flange of the wall bracket 113. Although the bridging member is shown in FIG. 5 joined to the article bracket 112 with a hinge, any means of rotatable joint would suffice, such as a hook and loop, swivel, pivot, slide mechanical fastener or the like. When the article bracket and the wall bracket are aligned and mounted, the bridging member is rotated over the wall bracket such that the wall bracket retaining appendage is disposed in the bridging member slot, thereby preventing longitudinal and axial movement of the article from the wall.

Hence, the improved restraint device provides a superior amount of protection against accidental physical movement of an article through a relatively simple, yet effective, means. An additional benefit of the present invention includes the ease of manufacture, which can be a fast, cost effective one step punching and forming process. Similarly, the simplicity of the restraint device lends itself to many diverse forms of manufacture such as injection molding, casting, extrusion as well as hot or cold stamping. Likewise, its simple straightforward design allows it to be quickly and easily installed in minutes without the use of professional help or even power-tools in many cases. The restraint device can be installed effectively on virtually any mechanically sound wall or structure, as well as most articles of furniture or appliances.

Once installed, several embodiments of the restraint device will be virtually out of sight, which is a welcome benefit to the appearance conscious consumer. The use of a bridging component eliminates the need for the installer to lift the article that is to be restrained. The bridging component also allows quick easy disengagement of the restraint device without the use of any tools or implements should the article of restraint need to be relocated or accessed. If after installation the restraint device is removed from the article, then it will not leave behind unsightly markings on the top, front or sides of the article. Hence no permanent disfigurement of the articles most visible areas will occur.

While several particular forms of the invention have been illustrated and described, it will be apparent that various modifications can be made without departing from the spirit and scope of the invention. For example, references to materials of construction and specific dimensions are also not intended to be limiting in any manner and other materials and dimensions could be substituted and remain within the spirit and scope of the invention. Accordingly, it is not intended that the invention be limited, except as by the appended claims.

What is claimed is:

1. A restraint device for securing an article to a vertical surface, comprising:

a first bracket configured to be secured to an article;

a second bracket configured to be secured to a vertical surface, said second bracket being disposed proximate said first bracket when the article is positioned proximate the vertical surface; and a bridging member having legs forming a U-shape and configured to lock said first bracket to said second bracket, wherein said first bracket and said second bracket are formed with recesses such that the legs of said bridging member are slidably disposed in the recesses to secure the article to the vertical surface, and wherein said bridging member may be removed from the recesses such that the article may positioned away from the vertical surface.

2. The restraint device of claim 1, wherein said bridging member further comprises an appendage for grasping and removing said bridging member.

3. The restraint device of claim 2, wherein said first bracket, said second bracket and said bridging member adapted to be positioned below a top surface of an article.

4. The restraint device of claim 1, further comprising fastening means, wherein said first bracket and said second bracket include a plurality of mounting holes for receiving said fastening means.

5. The restraint device of claim 1, further comprising a pair of mounting pedestals each having a mounting flange and a gripping member configured substantially at a right angle to the mounting flange, wherein the first bracket is slidably disposed in the pair of mounting pedestals.

6. A restraint device for securing an article to a vertical surface, comprising:

a first bracket configured to be mounted to a vertical surface, said first bracket having a recess;

a second bracket configured to be mounted to a top surface of an article, said second bracket including a longitudinal slot; and a bridging member having a first leg and a second leg forming a U-shape and configured to be retained within the slot of said second bracket and the recess of said first bracket, wherein the first leg of said bridging member is slidably disposed within the slot of said second bracket and the second leg of said bridging member is slidably disposed in the recess of said first bracket to secure the article to the vertical surface, and wherein said bridging member may be removed from the slot and recess such that the article may positioned away from the vertical surface.

7. The restraint device of claim 6, wherein said bridging member further comprises an appendage for grasping and removing said bridging member.

8. The restraint device of claim 7, further comprising fastening means, wherein said first bracket and said second bracket include a plurality of mounting holes for receiving said fastening means.

9. The restraint device of claims 6, wherein said first bracket is disposed substantially flush with the top of the article and said second bracket includes a stop flange for engaging said first bracket.

10. A restraint device for mounting an article to a vertical structure, comprising:

a first bracket having a first plate, said first bracket configured for mounting to a vertical structure;

a second bracket configured for mounting on a top surface of an article, said second bracket having a second plate configured to mount substantially flush with the first plate of said first bracket, the second plate of said second bracket being perpendicular to the top surface of the article; and a bridging member having legs forming a U-shape and configured to be slidably disposed over the first plate of said first bracket and the second plate of said second bracket, wherein said first bracket and said second bracket are formed with recesses such that the legs of said bridging member are slidably disposed in the recesses to secure the article to the vertical structure, and wherein said bridging member may be removed from the recesses such that the article may positioned away from the vertical structure.

11. The restraint device of claim 10, wherein the second plate of said second bracket has a first end having a first gusset and a first mounting flange and the second plate further has a second end having a second gusset and a second mounting flange.

12. The restraint device of claim 11, wherein said bridging member further comprises an appendage for grasping and removing said bridging member.

13. A method for securing an article to a vertical surface, the method comprising the steps of:

securing a first bracket having a first indentation to a vertical surface of an article;

securing a second bracket having a second indentation to a vertical surface not part of the article; and securing said first bracket to said second bracket with a bridging component being substantially U-shaped and configured to be slidably disposed within the first indentation of said first bracket and the second indentation of the second bracket, wherein the bridging member may be removed from the first and second indentations such that the article may positioned away from the vertical surface.

* * * * *